US009134642B2

(12) United States Patent
Miyazaki et al.

(10) Patent No.: US 9,134,642 B2
(45) Date of Patent: Sep. 15, 2015

(54) IMAGE FORMING APPARATUS

(71) Applicants: Rumi Miyazaki, Osaka (JP); Kyoko Abe, Osaka (JP)

(72) Inventors: Rumi Miyazaki, Osaka (JP); Kyoko Abe, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/076,432

(22) Filed: Nov. 11, 2013

(65) Prior Publication Data

US 2014/0153941 A1 Jun. 5, 2014

(30) Foreign Application Priority Data

Nov. 30, 2012 (JP) ..... 2012-262832

(51) Int. Cl.
*G03G 13/22* (2006.01)
*G03G 15/01* (2006.01)
*G03G 15/00* (2006.01)

(52) U.S. Cl.
CPC ..... *G03G 15/0189* (2013.01); *G03G 15/5058* (2013.01); *G03G 2215/0158* (2013.01)

(58) Field of Classification Search
USPC ..... 399/49
See application file for complete search history.

(56) References Cited

U.S. PATENT DOCUMENTS

| | | | | |
|---|---|---|---|---|
| 4,924,806 | A * | 5/1990 | Mizuno et al. | 399/225 |
| 7,139,511 | B2 | 11/2006 | Ishibashi | |
| 7,324,769 | B2 * | 1/2008 | Yamaoka | 399/49 |
| 2005/0179710 | A1 * | 8/2005 | Tatsuta et al. | 347/5 |
| 2008/0075480 | A1 | 3/2008 | Konishi et al. | |
| 2008/0131174 | A1 | 6/2008 | Inoue et al. | |
| 2008/0199792 | A1 | 8/2008 | Kawasaki et al. | |
| 2008/0267641 | A1 | 10/2008 | Konishi et al. | |
| 2008/0280225 | A1 | 11/2008 | Konishi et al. | |
| 2009/0035029 | A1 * | 2/2009 | Kobayashi | 399/298 |
| 2010/0098441 | A1 | 4/2010 | Miyazaki et al. | |
| 2011/0026943 | A1 | 2/2011 | Konishi et al. | |
| 2012/0002990 | A1 * | 1/2012 | Takeuchi | 399/49 |
| 2012/0045234 | A1 * | 2/2012 | Suzuki et al. | 399/49 |
| 2012/0321356 | A1 * | 12/2012 | Sakamoto | 399/301 |
| 2013/0058670 | A1 | 3/2013 | Nakatake et al. | |
| 2013/0078010 | A1 * | 3/2013 | Inoue et al. | 399/301 |
| 2013/0202318 | A1 * | 8/2013 | Ariizumi | 399/27 |
| 2013/0266331 | A1 * | 10/2013 | Suzuki | 399/49 |

FOREIGN PATENT DOCUMENTS

| | | |
|---|---|---|
| JP | 2006-139180 | 6/2006 |
| JP | 2007-316237 | 12/2007 |
| JP | 2011-170314 | 9/2011 |

* cited by examiner

*Primary Examiner* — Clayton E Laballe
*Assistant Examiner* — Linda B Smith
(74) *Attorney, Agent, or Firm* — Oblon, McClelland, Maier & Neustadt, L.L.P.

(57) ABSTRACT

An image forming apparatus includes an image forming device to form a toner image according to image data, a density adjustment toner pattern, and a timing adjustment toner pattern on an image bearer, a detector to detect the density adjustment toner pattern and the timing adjustment toner pattern, and an image density adjustment unit to execute image density adjustment based on an amount of toner adhering to the density adjustment toner pattern detected by the toner amount detector. The image density adjustment unit causes the image forming device to form the timing adjustment toner pattern before the density adjustment toner pattern is formed, and the image density adjustment unit adjusts a detection timing of the density adjustment toner pattern based on a detection timing of the timing adjustment toner pattern detected by the toner amount detector.

20 Claims, 9 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2012-262832, filed on Nov. 30, 2012, in the Japan Patent Office, the entire disclosure of which is hereby incorporated by reference herein.

BACKGROUND OF THE INVENTION

1. Technical Field

The present invention generally relates to an image forming apparatus, such as, a copier, a printer, a facsimile machine, a plotter, or a multifunction peripheral (MFP) including at least two of coping, printing, facsimile transmission, plotting, and scanning capabilities and, more particularly, to an image forming apparatus to transfer a toner image formed on an image bearer onto a recording medium.

2. Description of the Background Art

In electrophotographic image forming apparatuses, generally image density fluctuates depending on environmental changes (such as changes in temperature and humidity) or changes (e.g., degradation) over time. Therefore, many electrophotographic image forming apparatuses execute image density adjustment at a predetermined timing to maintain a constant image density. In typical image density adjustments, a gradation pattern, constructed of multiple toner patches that differ in target image density, is formed on an image bearer such as a photoreceptor, and the density of each toner patch is detected by an image density sensor such as an optical sensor. Then, based on detection results (outputs from the density sensor) of each toner patch, image forming conditions such as exposure energy (exposure power), charge bias, and development bias are changed so that a target amount of adhering toner can be attained with a specific image density. Additionally, the concentration of toner in developer used as a control referent is changed as required to adjust the concentration of toner in developer.

Optical sensors including a light-emitting element, such as a light-emitting diode (LED), and a light-emitting element, such as a phototransistor, are often used as the density sensor for detecting the amount of toner adhering to (i.e., amount of adhering toner) each toner patch forming the gradation pattern. Generally, as such optical sensors, there are three types of sensors, those to detect specular reflection light only, those to detect diffuse reflection light only, and those to detect both types of light. To detect the amount of toner adhering to each toner patch forming the gradation pattern using the optical sensor, the gradation pattern is formed on a surface (a surface to be detected) of a bearer (hereinafter "pattern bearer"), such as an image bearer and sheet conveyance member, configured to bear the gradation pattern, and the LED light is directed to the each toner patch carried on the pattern bearer. Then, the light-receiving element detects light reflected (specular reflection or diffuse reflection) therefrom, and the result of detection (outputs from the optical sensor) is converted into the amount of toner adhering to each toner patch.

To detect the amount of toner adhering to each toner patch accurately using such an optical sensor, it is preferred that the light-receiving element of the optical sensor receive only the light reflected from the toner patch. In other words, it is preferred that the light received by the light-receiving element of the optical sensor does not include light reflected from the background on the surface to be detected, where the toner patch is not present. For that, the toner patch should be greater than a spot diameter of light, applied by the light-emitting element, on the surface to be detected.

However, a positional deviation may be caused between the position of the toner patch on the surface to be detected and the position where the optical sensor is disposed due to tolerances in manufacturing or assembling. Accordingly, the length of the toner patch in the direction in which the surface of the pattern bearer moves (hereinafter simply "length of the toner patch") is made longer than the spot diameter so that the spot diameter falls within the toner patch at the time of the measurement by the optical sensor, even if such a deviation is present.

By contrast, as the length of the toner patch increases, the amount of toner used to form the toner patch increases, resulting in increases in frequency of replacement of a waste-toner container and the running cost of the image forming apparatus. Further, as the amount of toner removed in removal of the toner patch increases, the load on a cleaning member increases, and the operational life of the cleaning member is shortened. Therefore, the length of the toner patch is preferably shorter regarding this inconvenience.

In an image forming apparatus proposed in JP-2007-316237-A, before forming a density patch (toner patch), a proper position at which a density patch is to be formed is calculated so that a detection range of a density sensor falls within the density patch. In this image forming apparatus, initially, a toner pattern for position detection (i.e., a position-detecting pattern) is formed on an image bearer and detected by the density sensor. Then, based on the detection results, the proper position for the density patch (an offset amount from a reference position of the density patch) is calculated. After the proper position of the density position is calculated, the density patch is formed at the calculated position and detected by the density sensor, and image density adjustment is performed based on the detection results.

According to JP-2007-316237-A, the density patch can be formed at a position adjusted in view of the above-described deviation, and it is not necessary to increase the length of the density patch in view of the deviation. Thus, the density patch can be shorter.

SUMMARY OF THE INVENTION

In view of the foregoing, one embodiment of the present invention provides an image forming apparatus that includes an image forming device to form a toner image according to image data, a density adjustment toner pattern, and a timing adjustment toner pattern on an image bearer; a detector to detect an amount of toner adhering to the density adjustment toner pattern and the timing adjustment toner pattern; and an image density adjustment unit to execute image density adjustment based on an amount of toner adhering to the density adjustment toner pattern detected by the detector. The image density adjustment unit causes the image forming device to form a timing adjustment toner pattern before the density adjustment toner pattern is formed. The image density adjustment unit adjusts detection timing of the density adjustment toner pattern based on timing at which the toner amount detector detects the timing adjustment toner pattern.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
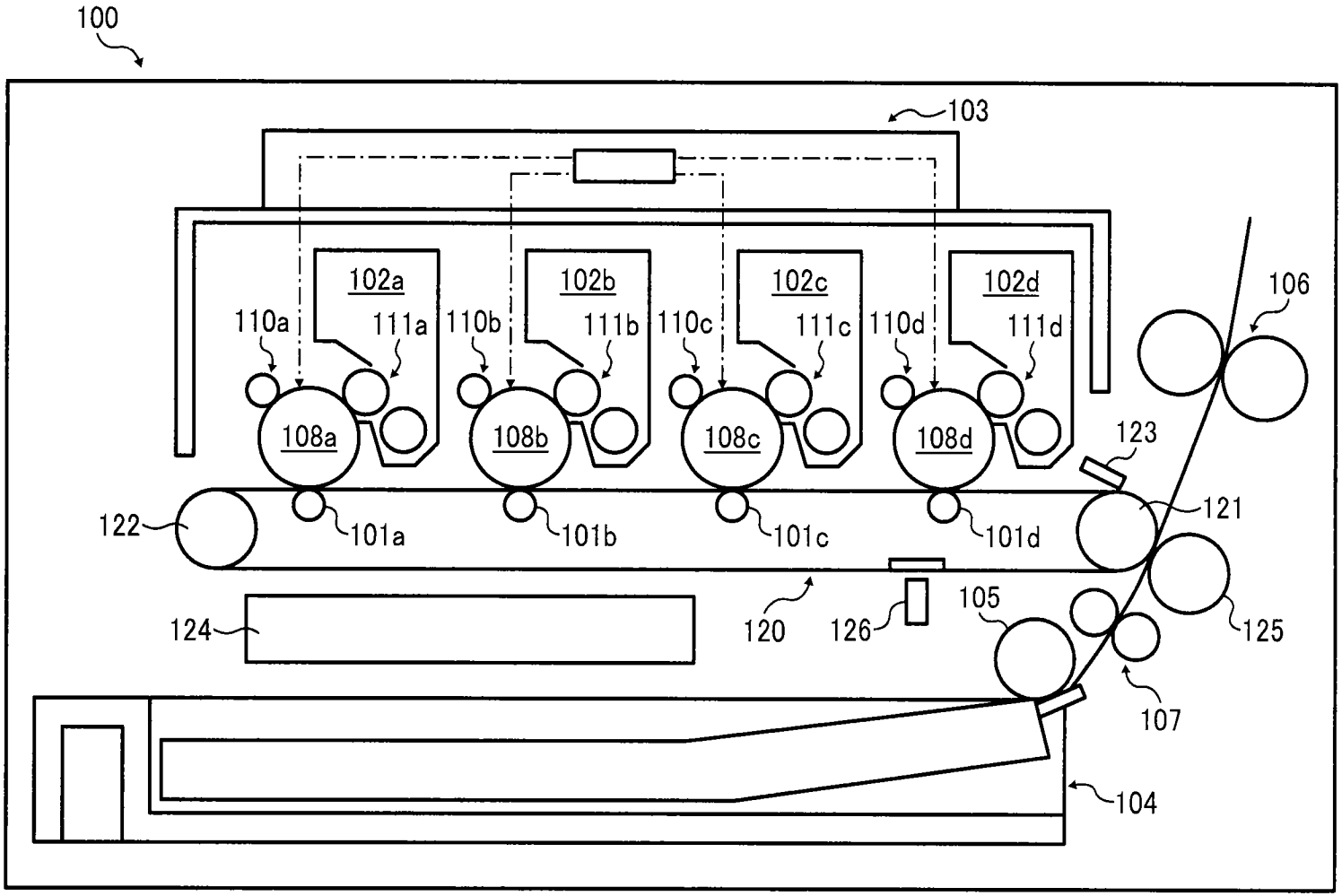
FIG. 1 is a schematic diagram of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described. The image forming apparatus according to the following embodiment can be, for example, an electrophotographic multicolor printer.

It is to be noted that the suffixes Y, M, C, and K and a, b, c, and d attached to each reference numeral indicate only that elements indicated thereby relate to yellow, magenta, cyan, and black images, respectively, and hereinafter may be omitted when color discrimination is not necessary.

It is to be noted that, although the description below concerns a tandem image forming apparatus employing an intermediate transfer method, the type of image forming apparatuses according to embodiments of the present invention is not limited thereto. Thus, the present embodiment can adapt to various types of image forming apparatuses such as tandem image forming apparatuses employing a direct transfer method and monochrome or single-color image forming apparatuses.

FIG. 1 is a schematic diagram of the image forming apparatus according to the present embodiment.

The image forming apparatus shown in FIG. 1 can be, for example, a typical tandem-type multicolor image forming apparatus and includes, as image forming units, process units or process cartridges 102*a*, 102*b*, 102*c*, and 102*d* for forming monochrome images (black images) and three colors such as cyan, magenta, and yellow for forming multicolor images. The process units 102*a*, 102*b*, 102*c*, and 102*d* are removably installable in an apparatus body 100. The process units 102*a*, 102*b*, 102*c*, and 102*d* together form an image forming device to form to multiple toner images to be superimposed into a single image (multicolor toner image).

Inside the apparatus body 100, further an exposure device 103, serving as a latent image forming unit, primary-transfer rollers 101*a*, 101*b*, 101*c*, and 101*d*, a paper feeding tray 104, and a fixing device 106, are provided.

The process units 102*a*, 102*b*, 102*c*, and 102*d* respectively include photoreceptors 108*a*, 108*b*, 108*c*, and 108*d* serving as image bearers. For example, each photoreceptor 108 is drum-shaped and rotates at a linear velocity of 150 mm/s in the present embodiment.

Roller-shaped charging devices 110*a*, 110*b*, 110*c*, and 110*d* are disposed in contact with surfaces of the respective photoreceptors 108*a*, 108*b*, 108*c*, and 108*d* to rotate as the photoreceptors 108*a*, 108*b*, 108*c*, and 108*d* rotate. Each charging device 110 receives charge bias that can be direct-current (DC) voltage or superimposed voltage in which alternating-current (AC) voltage is superimposed on DC voltage from a high-voltage power source. The charging device 110 electrically charges the surface of the photoreceptor 108 uniformly.

The charged surface of the photoreceptor 108 is then exposed according to each color image data by the exposure device 103. Thus, an electrostatic latent image is formed thereon. For example, the exposure device 103 employs a laser beam scanner using a laser diode or light-emitting diode (LED) arrays.

The electrostatic latent images on the photoreceptors 108*a*, 108*b*, 108*c*, and 108*d* are developed with respective color toners into toner images by developing devices 111*a*, 111*b*, 111*c*, and 111*d*. Although a contact-type one-component developing device is used in the present embodiment, a two-component developing device may be used instead. In each developing device 111, a high-voltage power source applies development bias to a developer bearer carrying toner, and the development bias causes toner on the developer bearer to adhere to the electrostatic latent image on the photoreceptor 108. Thus, the electrostatic latent images on the respective photoreceptors 108*a*, 108*b*, 108*c*, and 108*d* are developed into toner images.

The four process units 102*a*, 102*b*, 102*c*, and 102*d* are arranged in the direction in which a surface of an intermediate transfer belt 120 moves (hereinafter also "belt rotation direction"). The intermediate transfer belt 120 serves as a transfer medium, to which toner images are transferred. In multicolor (full-color) image formation, the respective toner images are primarily transferred onto the intermediate transfer belt 120 in the order of black, cyan, magenta, and yellow. The primary-transfer rollers 101*a*, 101*b*, 101*c*, and 101*d* are disposed facing the respective photoreceptors 108*a*, 108*b*, 108*c*, and 108*d* via the intermediate transfer belt 120. From high-pressure power sources provided separately for the respective colors, the primary-transfer rollers 101*a*, 101*b*, 101*c*, and 101*d* each receive predetermined transfer bias, for example, within a range from +400 V to +1200 V. With the effect of transfer electrical fields generated by the transfer biases, the toner images are transferred primarily from the photoreceptors 108*a*, 108*b*, 108*c*, and 108*d* and superimposed one on another on the intermediate transfer belt 120.

The intermediate transfer belt 120 is stretched around multiple rollers including a driving roller 122, the primary-transfer rollers 101*a*, 101*b*, 101*c*, and 101*d*, and a tension roller 121 and rotates as the driving roller 122 rotates, driven by a driving motor. Both axial ends of a shaft of the tension roller 121 are urged by a bias member such as a spring to give a predetermined degree of tension to the intermediate transfer belt 120. In the present embodiment, the tension roller 121 is constructed of an aluminum pipe having a diameter of 19 mm and a roller width of 231 mm. Flanges are fitted in both end portions thereof, and the flanges can inhibit the intermediate transfer belt 120 from meandering.

After the primary image transfer, toner remaining on the respective photoreceptors 108 is removed by cleaning units and collected in a waste-toner container 124. Alternatively, instead of providing cleaning units, a so-called cleaner-less method may be used so that the toner remaining after image transfer is reused by the developing devices 111. Additionally, a cleaning blade 123 scrapes off toner remaining on the intermediate transfer belt 120, and the removed toner is collected in the waste-toner container 124.

A sheet feeding roller 105 and a pair of registration rollers 107 transport sheets of recording media, timed to coincide with the arrival of the toner image formed on the intermediate transfer belt 120 to a secondary-transfer position facing a secondary-transfer roller 125. A high-voltage power source applies a secondary-transfer bias to the secondary-transfer roller 125, and thus the toner image is transferred from the intermediate transfer belt 120 onto the sheet. In the present embodiment, a sheet feeding channel is vertical as shown in FIG. 1. The sheet is separated from the intermediate transfer belt 120 due to the curvature of the secondary-transfer roller 125. The toner image is then fixed by the fixing device 106, after which the sheet is discharged outside the apparatus body 100.

The primary-transfer rollers 101*a*, 101*b*, and 101*c* corresponding to other colors than black can be disengaged from intermediate transfer belt 120 by a shifting unit. In monochrome image formation, the shifting unit disengages the primary-transfer rollers 101*a*, 101*b*, and 101*c* from the intermediate transfer belt 120.

In the present embodiment, a density sensor 126 is disposed facing the intermediate transfer belt 120 to detect a image density adjustment pattern including multiple density adjustment toner patches. In particular, the density sensor 126 detects the amount of toner adhering to each density adjustment toner patch.

The density sensor 126 can receives light reflected from the density adjustment toner patch using an optical sensor including a light-emitting element, such as light-emitting diode (LED), and a light-receiving element, such as phototransistor. Then, the density sensor 126 can obtain the amount of toner adhering based on image density corresponding to the amount of reflected light. The density sensor 126, however, is not limited to the optical sensor but may be another type sensor as long as the amount of toner adhering to the density adjustment toner patch can be detected.

Figure 2:
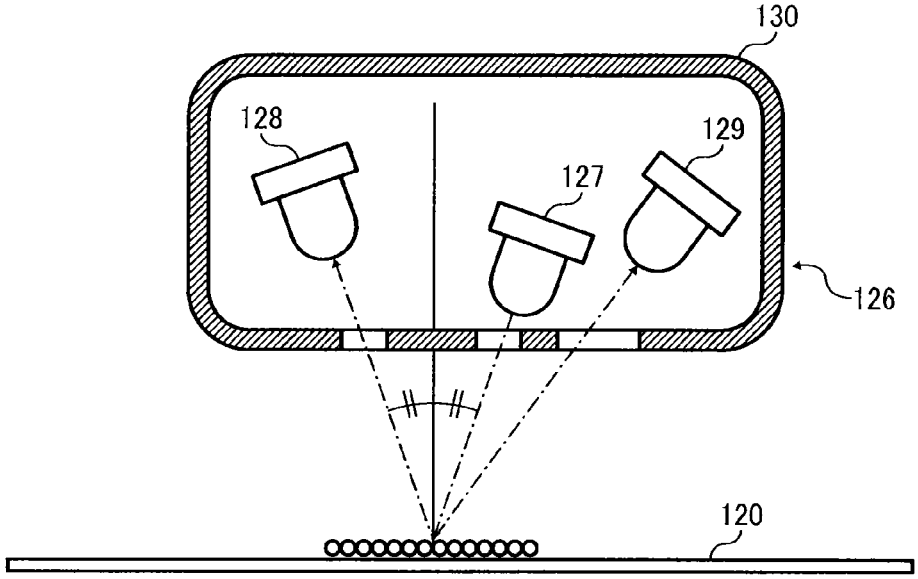
FIG. 2 is a schematic diagram of a density sensor according to an embodiment.

FIG. 2 is a schematic diagram of the density sensor 126 according to the present embodiment.

The density sensor 126 according to the present embodiment includes an infrared light LED 127, a light-receiving element 128 to receive specular reflection light (hereinafter "specular reflection receiver 128"), a light-receiving element 129 to receive diffuse reflection light (hereinafter "diffuse reflection receiver 129"), and a casing 130 to house these elements. Instead of the infrared light LED, a different type light-emitting element such as a laser emitting element may be used. Although phototransistors are used for the specular reflection receiver 128 and the diffuse reflection receiver 129, other configurations, such as those employing a photodiode and an amplification circuit may be used.

In the present embodiment, the density sensor 126 is disposed downstream from the primary-transfer roller 101 d and upstream from the cleaning blade 123 in the rotation direction (indicated by arrow A shown in FIG. 3, hereinafter "belt rotation direction A") of the intermediate transfer belt 120. This arrangement enables the single density sensor 126 to detect multiple color toner patches. Alternatively, a density sensor may be provided to each of the multiple photoreceptors 108 so that the toner patch can be detected on each photoreceptor 108 although the number of sensors increases in this configuration.

In the present embodiment, image density is adjusted according to detection results generated by the density sensor 126 detecting toner the density adjustment toner patches.

Further, the density sensor 126 according to the present embodiment detects a toner pattern for adjusting relative positions among the toner images superimposed one on another (i.e., position adjustment pattern) to correct deviation (i.e., color deviation) among respective color toner images superimposed on the intermediate transfer belt 120. In accordance with the timing when the position adjustment pattern is detected, position adjustment is executed to adjust the relative positions of the respective color toner images.

In a comparative configuration in which the position at which the density adjustment toner patch is to be formed is calculated based on detection results of the position adjustment toner pattern detected by the density sensor, that is, formation of the density adjustment toner patch can be formed only after the proper position thereof is obtained based on the detection results of the position adjustment toner pattern, it takes time from formation of the position adjustment toner pattern to formation of the density adjustment toner patch. Accordingly, it takes longer time for image density adjustment. In particular, in image forming apparatuses in which the toner pattern travels a long distance to the detection range of the density sensor, the time of image density adjustment is longer.

In view of the foregoing, according to the present embodiment, the time of image density adjustment can be shortened while inhibiting an inconvenience caused when the toner patch is relatively long. These adjustments are described in further detail later.

Figure 3:
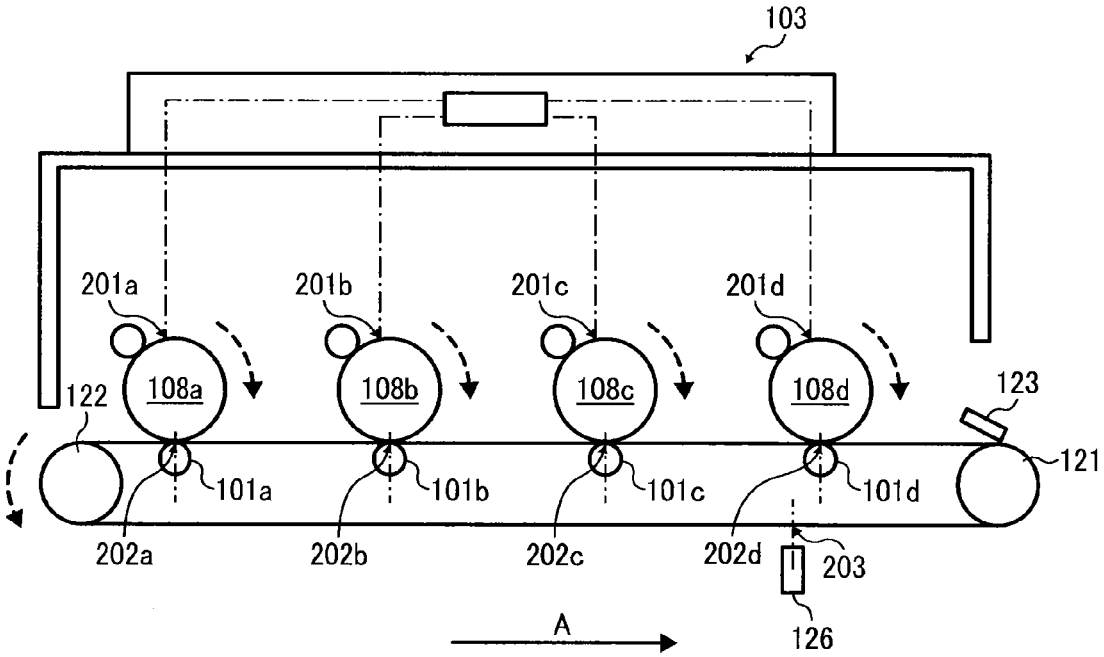
FIG. 3 is a diagram for understanding of a route of color toner patches formed on respective photoreceptors until the toner patches are detected by the density sensor shown in FIG. 2.

FIG. 3 is a diagram for understanding of a route of the respective color toner patches formed on the photoreceptors 108 until the toner patches are detected by the density sensor 126.

The toner patches for image density adjustment are formed through processes identical or similar to those for forming standard toner images. More specifically, the photoreceptors 108*a*, 108*b*, 108*c*, and 108*d* are exposed at exposure positions 201*a*, 201*b*, 201*c*, and 201*d* by the exposure device 103, and electrostatic latent images for the toner patches are formed. Then, the developing devices 111*a*, 111*b*, 111*c*, and 111*d* develop the electrostatic latent images for the toner patches with the respective color toners, and thus the respective color toner patches are formed. At primary-transfer positions 202*a*, 202*b*, 202*c*, and 202*d*, the toner patches are transferred onto the intermediate transfer belt 120 and transported to a detection position 203 by the density sensor 126 as the intermediate transfer belt 120 rotates. The above-described position adjustment pattern can be formed through the processes similar to those for forming the density adjustment toner patches.

Figure 4:
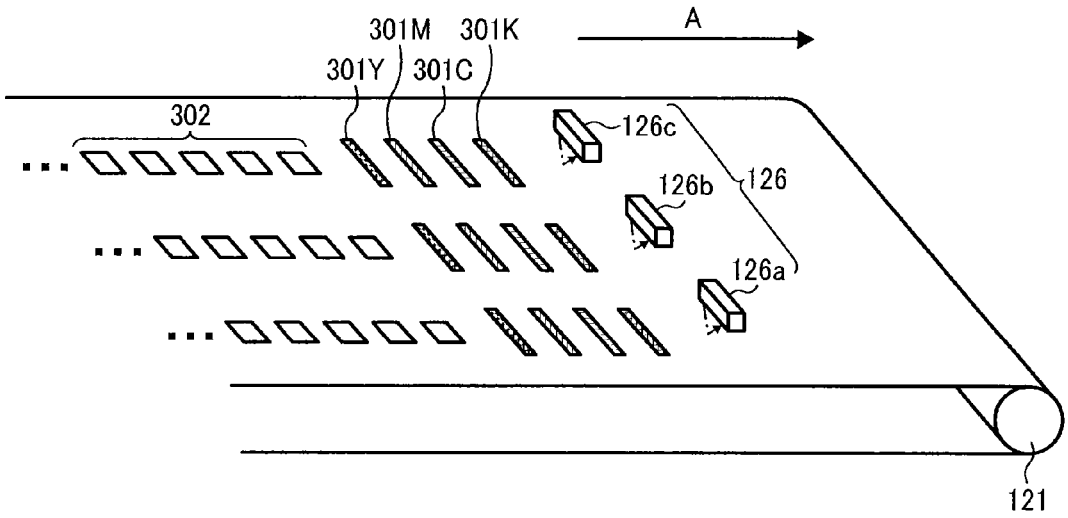
FIG. 4 is a perspective view illustrating an intermediate transfer belt, carrying position adjustment patterns and gradation patterns for image density adjustment, and the density sensor shown in FIG. 2.

FIG. 4 is a perspective view illustrating the intermediate transfer belt 120, carrying the position adjustment pattern and density adjustment toner patches (i.e., gradation pattern), and the density sensor 126 to detect these patterns. It is to be noted that, in FIG. 4, reference numerals 301 represents the position adjustment patterns and 302 represents the gradation patterns each constructed of multiple density adjustment toner patches (reference number 302P is given in FIG. 8).

In the configuration shown in FIG. 4, the position adjustment patterns 301K, 301C, 301M, and 301Y for respective colors and the gradation patterns 302 are formed along the belt rotation direction A (hereinafter also "sub-scanning direction") at three positions in total in a width direction of the intermediate transfer belt 120, namely, a middle position and both end positions. Accordingly, the density sensor 126 includes three sensors 126*a*, 126*b*, and 126*c* disposed corresponding to the three positions.

In the present embodiment, as shown in FIG. 4, the position adjustment patterns 301K, 301C, 301M, and 301Y and the gradation patterns 302 are formed in succession in this order and detected by the density sensor 126. In the present embodiment, although position adjustment and image density adjustment can be executed independently of each other, the position adjustment patterns 301K, 301C, 301M, and 301Y are formed before the gradation patterns 302 are formed when both adjustments are executed at similar timings. With this sequence, the position adjustment patterns 301 can be used for adjusting the timing of detection as well.

Accordingly, the position adjustment patterns 301 can serve as a timing adjustment toner pattern, and the density sensor 126 can serve as a detector to detect the density adjustment toner pattern (or the toner patch) and the timing adjustment toner pattern.

Figure 5:
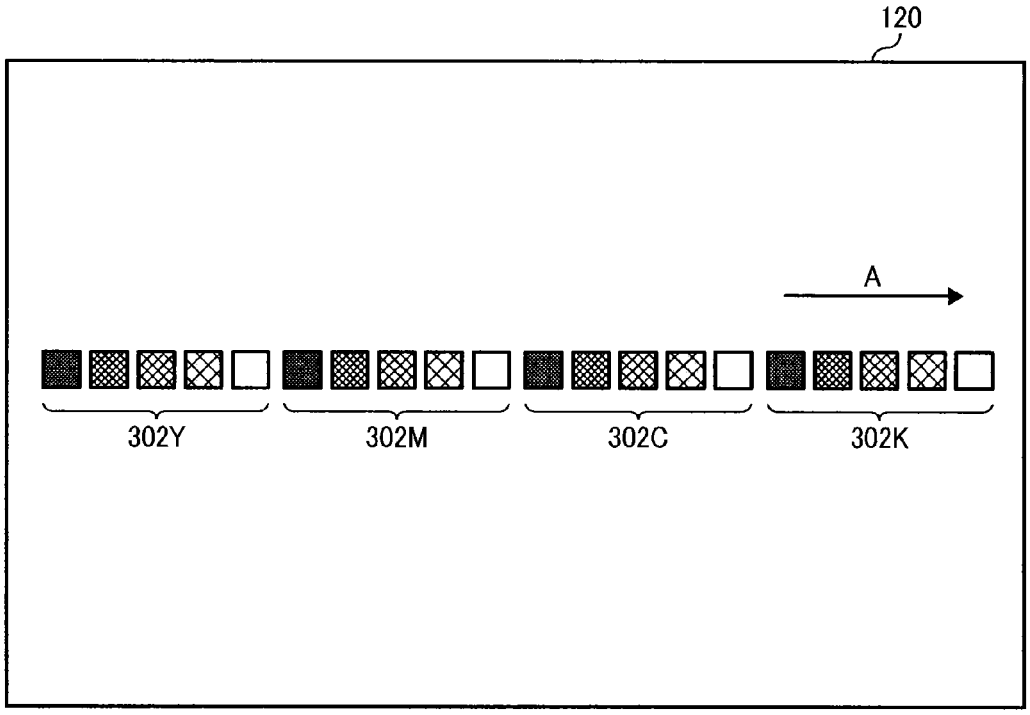
FIG. 5 illustrates an example of toner patches for image density adjustment according to an embodiment.

FIG. 5 illustrates an example of the gradation patterns 302 according to the present embodiment.

It is to be noted that, for simplicity, FIG. 5 illustrates only the gradation patterns 302Y, 302M, 302C, and 302K formed at the middle position in the belt width direction, and those formed at the both end positions in the belt width direction are omitted.

As shown in FIG. 5, the gradation pattern 302 is constructed of, for example, five toner patches designed to differ in the amount of toner adhering thereto (image density). The gradation pattern 302 is formed for each color. The number of patches forming the gradation pattern 302 for each color is not limited to five. The gradation patterns 302K, 302C, 302M, and 302Y are formed on the intermediate transfer belt 120 in that order along the direction A in which the intermediate transfer belt 120 rotates.

It is to be noted that the gradation patterns 302 formed at the both end positions in the belt width direction are identical or similar to those formed at the middle position. The amount of toner adhering to each toner patch (image density) can be varied by changing image forming conditions such as the development bias, the charge bias, and the amount of exposure energy (exposure power).

Figure 6:
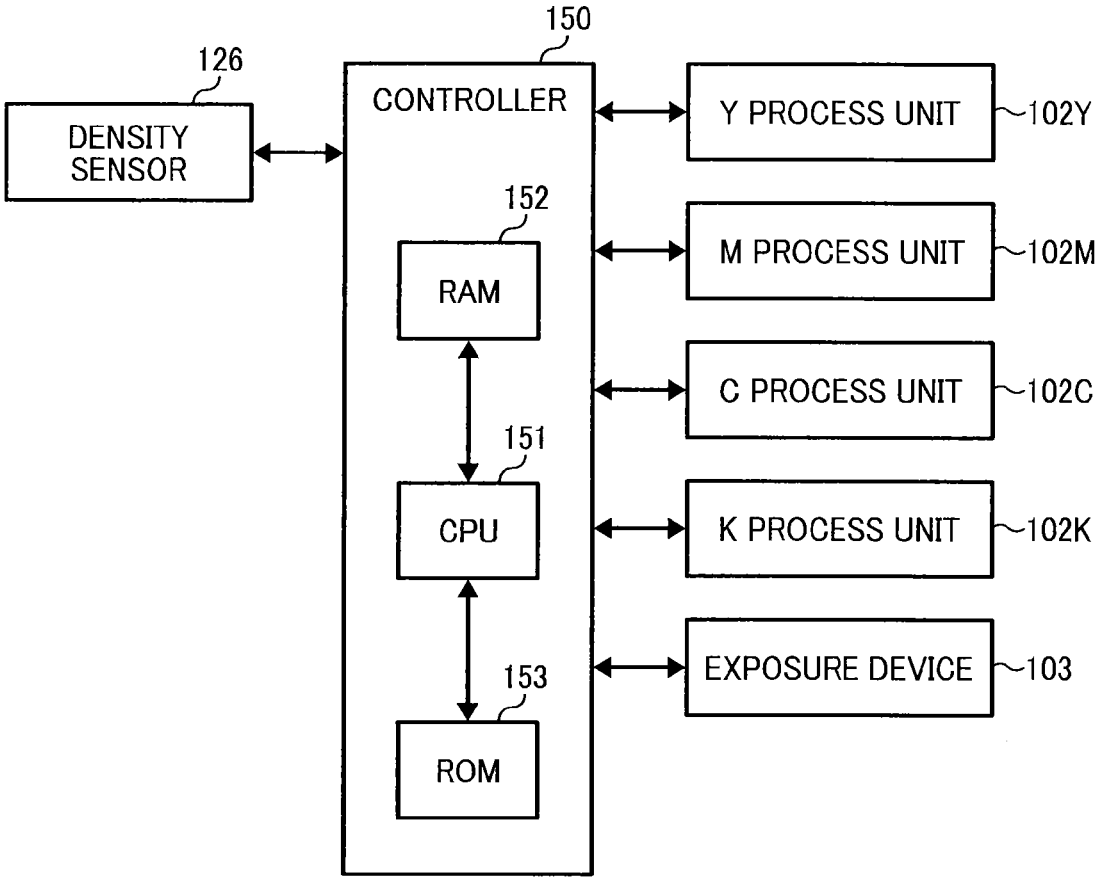
FIG. 6 is a block diagram illustrating electrical circuitry of the image forming apparatus shown in FIG. 1.

FIG. 6 is a block diagram illustrating electrical circuitry of the image forming apparatus according to the present embodiment.

In FIG. 6, a controller 150 includes a central processing unit (CPU) 151 serving as a computing unit, a nonvolatile random access memory (RAM) 152, serving as a storage device, and a read only memory (ROM) 153, serving as a storage device. The process units 102, the exposure device 103, the density sensor 126, and the like are connected to the controller 150. The controller 150 controls these devices according to control programs stored in the RAM 152 and the ROM 153.

The controller 150 also controls the image forming conditions to form images. Specifically, the controller 150 individually controls the charge biases applied to the charging devices 110*a*, 110*b*, 110*c*, and 110*d* in the process units 102*a*, 102*b*, 102*c*, and 102*d*. With this control, the photoreceptors 108*a*, 108*b*, 108*c*, and 108*d* are uniformly charged to target potentials individually set for yellow, magenta, cyan, and black. Additionally, the controller 150 individually sets the exposure power (exposure energy) of four semiconductor lasers of the exposure device 103 corresponding to the process units 102*a*, 102*b*, 102*c*, and 102*d*. Additionally, the controller 150 controls application of the development biases individually set for yellow, magenta, cyan, and black to the developer bearers in the process units 102*a*, 102*b*, 102*c*, and 102*d*. This control enables development potentials individually set for the respective colors to act between the respective developer bearers and the electrostatic latent images formed on the photoreceptors 108*a*, 108*b*, 108*c*, and 108*d* to electrostatically transfer toner from the developer bearers to the photoreceptors 108. Thus, the electrostatic latent images can be developed to have a desirable image density (desirable amount of adhering toner).

Figure 7:
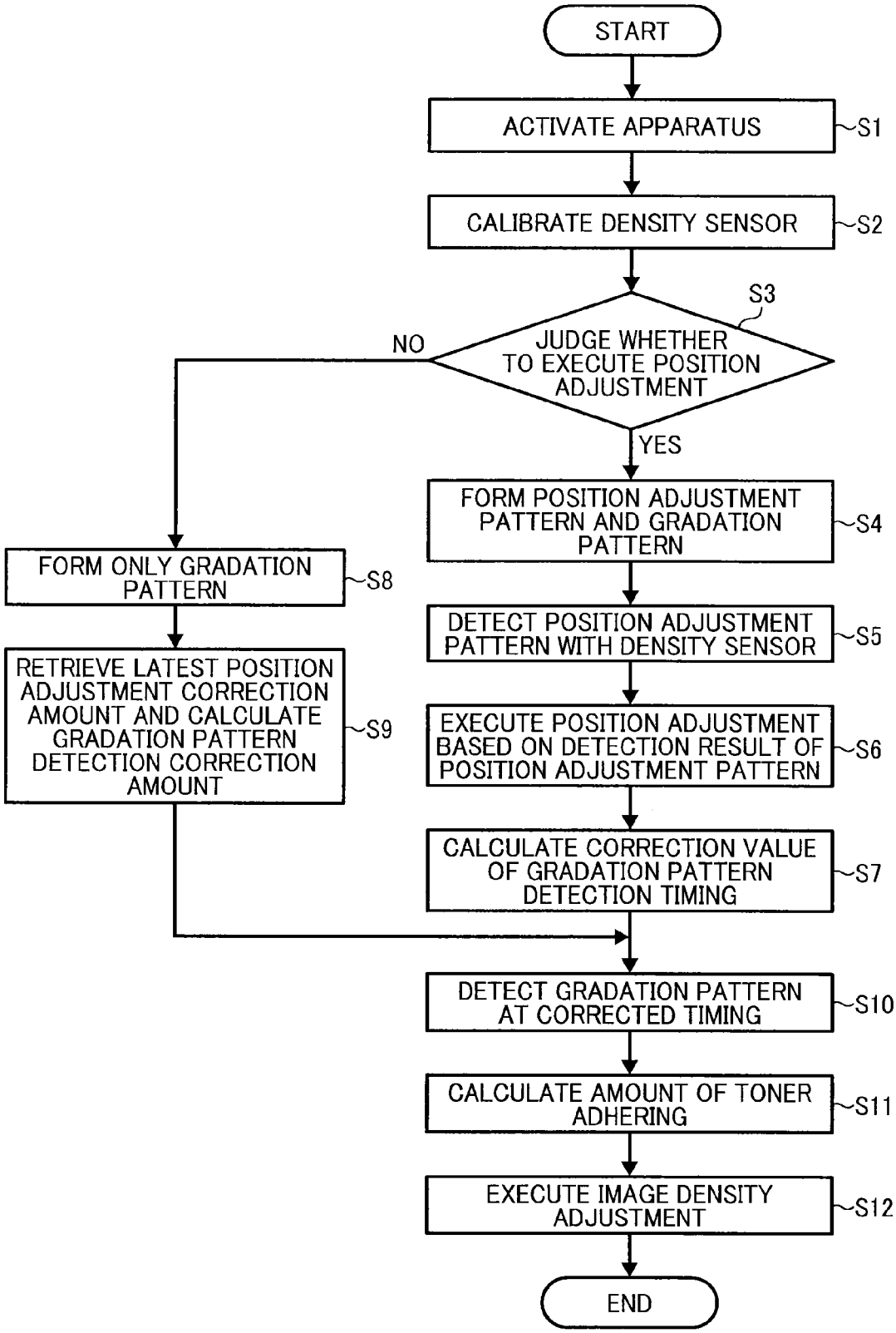
FIG. 7 is a flowchart of image quality adjustment according to an embodiment.

FIG. 7 is a flowchart illustrating a control flow of the image quality adjustment according to the present embodiment.

It is to be noted that the term "image quality adjustment" used in this specification includes at least image density adjustment. The control flow shown in FIG. 7 further includes position adjustment.

The controller 150 executes the image quality adjustment each time power is turned on or the number of printed sheets reaches a predetermined number, and the image quality adjustment includes image density adjustment to adjust the image density of respective colors. It is to be noted that FIG. 7 illustrates the control flow of the image quality adjustment at power-on.

At S1 power is turned on and the apparatus is activated, and at S2 the controller 150 executes calibration of the density sensor 126. Specifically, the intensity of light emitted from the infrared light LED 127, serving as the light-emitting element, of the density sensor 126, is adjusted so that the output from the light-receiving element 128 (hereinafter "specular reflection light output") falls with a predetermined range (a reference value plus or minus tolerance), for example, 4±0.5 V.

More specifically, when the calibration of the density sensor 126 is started, the infrared light LED 127 is turned on, and the density sensor 126 obtains the specular reflection light output reflected from the background area of the intermediate transfer belt 120. Then, the value of electrical current applied to the infrared light LED 127 is adjusted so that the specular reflection light output falls within the predetermined range. In the present embodiment, using a binary search, a current value with which the specular reflection light output becomes closest to the reference value (for example, 4V) is determined. If the specular reflection light output is not within the predetermined range as the result of the binary search, the calibration of the density sensor 126 is deemed defective.

If the calibration is defective three times in succession, the controller 150 recognizes that there is a failure and stops operation of the apparatus. Additionally, in the present embodiment, an upper limit of the current applied to the infrared light LED 127 is 30 mA to prevent or inhibit damage to the infrared light LED 127. When the specular reflection light output falls within the predetermined range, the current value at that time is stored in the apparatus body 100.

It is to be noted that, since it takes time to calibrate the density sensor 126, the following operation may be performed to omit the calibration. Use the current value at the previous adjustment to apply light from the infrared light LED 127 to the background on the intermediate transfer belt 120. Detect the specular reflection light, and calculate a mean value of the specular reflection light outputs. When the mean value is within the predetermined range, the calibration of the density sensor 126 can be deemed unnecessary.

Subsequently, at S3, the controller 150 judges whether to execute the position adjustment based on predetermined conditions. Specifically, the position adjustment is performed when conditions that lead to a high probability of occurrence of deviation in relative positions of respective colors are satisfied, for example, when the environments such as temperature and humidity change significantly or the adjustment is instructed by a user.

When the position adjustment is to be performed (Yes at S3), at S4 the controller 150 instructs formation of the position adjustment patterns 301 and the gradation patterns 302 for the respective colors so that these patterns pass though the positions on the intermediate transfer belt 120 at which the intermediate transfer belt 120 faces the sensors 126*a*, 126*b*, and 126*c* as shown in FIGS. 4 and 5. With this operation, in the respective process units 102, the electrostatic latent images for the position adjustment pattern and the gradation pattern are formed sequentially on the photoreceptors 108 and developed into the position adjustment patterns 301 and the gradation patterns 302 by the developing devices 111. Then, the position adjustment patterns 301 and the gradation patterns 302 are transferred from the respective photoreceptors 108 onto the intermediate transfer belt 120 and transported to the detection range of the density sensor 126 as the intermediate transfer belt 120 rotates.

At S5, the density sensor 126 initially detects the respective color position adjustment patterns 301K, 301C, 301M, and 301Y sequentially. The controller 150 can recognize the amount of deviation in relative positions among respective colors in the sub-scanning direction or belt rotation direction A from the timings at which the density sensor 126 detects the position adjustment patterns 301K, 301C, 301M, and 301Y.

At S6, to eliminate the deviation in relative positions, the controller 150 calculates the mount by which each color exposure start timing is corrected (hereinafter also "correction amount of exposure timing") and executes the position adjustment to correct these timings. The calculated correction amount of exposure timing is stored in the RAM 152 of the controller 150 as a latest correction amount. In subsequent image formation, the start timing of exposure according to image data can be corrected using the latest correction amount.

Subsequently, the density sensor 126 detects the amount of toner adhering to each toner patch in the respective color gradation patterns 302K, 302C, 302M, and 302Y.

It is to be noted that hereinafter the terms "patch travel times Ta, Tb, Tc, and Td" mean time periods from the points of time when exposure (i.e., latent image formation) is started at the exposure positions 201*a*, 201*b*, 201*c*, and 201*d* for forming the respective color toner patches to the points of time when the respective toner patches arrive at the detection position 203 (the start of proper detection of the amount of toner adhering to the respective color toner patches).

The patch travel times Ta, Tb, Tc, and Td fluctuate within a certain range, affected by variations in diameter of the photoreceptors 108 among colors, variations in rotational velocity of motors to drive the photoreceptors 108 among colors, expansion and contraction of the intermediate transfer belt 120 caused by environmental changes and changes over time, differences in assembling or installation of the density sensor 126, individual differences in beam irradiation positions (beam spot position of the infrared light LED 127), and the like. Therefore, it is possible that the arrival timings of the gradation patterns 302 (toner patches) at the detection position 203 can vary among colors when the gradation patterns 302 are formed at fixed timings constantly.

Figure 8:
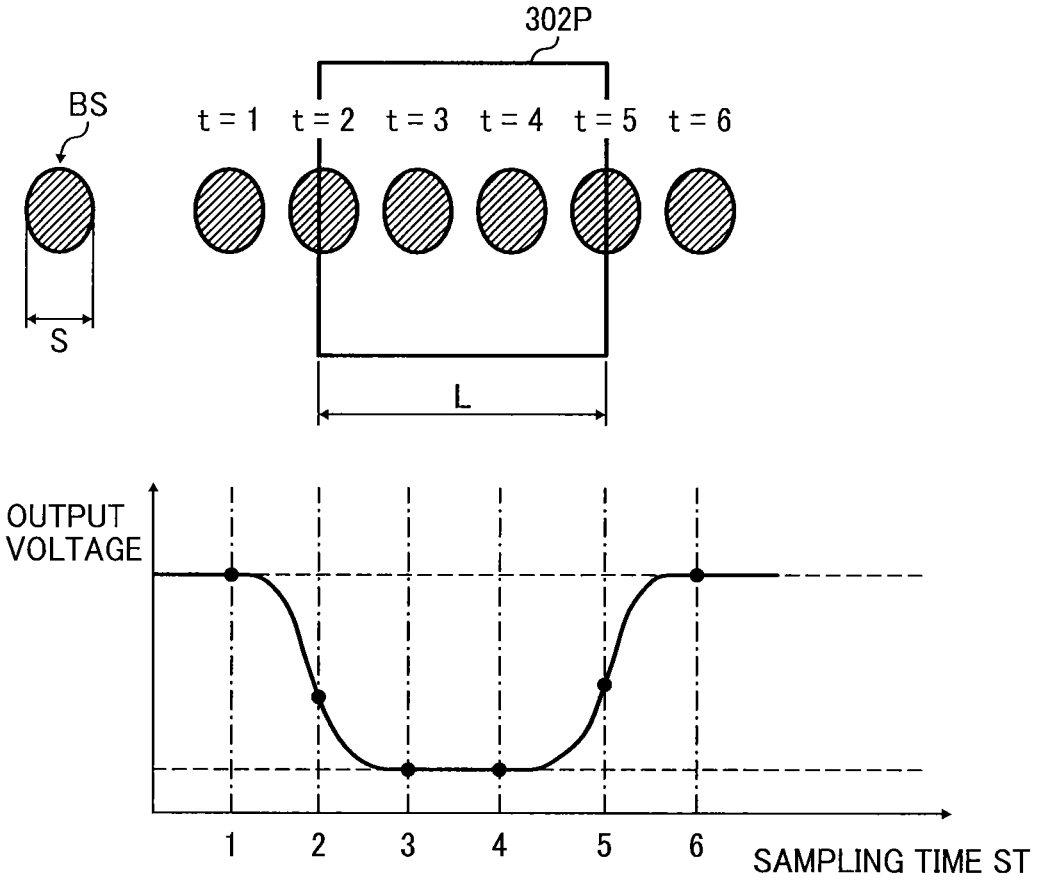
FIG. 8 is a diagram for understanding of the relative positions of the gradation pattern and the beam spot of the density sensor and an output voltage of the density sensor.

FIG. 8 is a diagram for understanding of the relation between the relative positions of a single toner patch 302P of the gradation pattern 302 and a beam spot BS (i.e., detection range) of the density sensor 126, and an output voltage of the density sensor 126.

An upper part of FIG. 8 illustrates the relative positions of the single toner patch 302P and the beam spot BS of the density sensor 126 at each sampling time point ST, and a lower part of FIG. 8 is a graph of the output (i.e., output voltage) from the specular reflection receiver 128 of the density sensor 126 at the time point ST. It is to be noted that the term "beam spot" used here means a range (on the intermediate transfer belt 120) irradiated with the beam emitted from the infrared light LED 127 of the density sensor 126.

In FIG. 8, at time points (ST=1 and 6) at which the beam spot BS is totally outside the range of the single toner patch 302P, the output voltage of the density sensor 126 is greatest among all time points (ST=1 through 6) shown in FIG. 8. The output voltage at time points ST=1 and ST=6 is identical or similar to an output voltage in a case in which strong specular reflection of light reflected from the surface of the intermediate transfer belt 120 is received. Additionally, at time points (ST=3 and ST=4) at which the beam spot BS fully enters the range of the single toner patch 302P, the output voltage is smallest among all the time points (ST=1 through 6). At those sampling time points, the specular reflection of light reflected from the surface of the intermediate transfer belt 120 is not received, and a small amount of specular reflection of light reflected from the single toner patch 302P is received. Thus, the output value can properly indicate the image density (toner adhering amount) of the single toner patch 302P.

By contrast, at time points (ST=2 and ST=5) at which the beam spot BS is partly inside the range of the single toner patch 302P, the output of the density sensor 126 is an intermediate value between the above-described greatest value and the smallest value. At those sampling times, both the strong specular reflection of light reflected from the surface of the intermediate transfer belt 120 and the small amount of specular reflection of light reflected from the single toner patch 302P are received. This output value does not properly indicate the image density (toner adhering amount) of the toner patch 302P.

Therefore, to properly detect the amount of toner adhering to the toner patch 302P, it is preferred to obtain the output voltage at the sampling times (ST=3 and ST=4 in FIG. 8) at which the beam spot BS fully enters the range of the single toner patch 302P separately from the above-described intermediate output voltage (at ST=2 and ST=5 in FIG. 8). As described above, however, the arrival timing of the toner patch 302P at the detection position 203 is not constant, and thus a proper sampling time at which the beam spot BS fully enters the range of the single toner patch 302P fluctuates. Accordingly, it is preferred to grasp the proper sampling time, which fluctuates, and obtain the output voltage at the proper sampling time from the density sensor 126.

To obtain such a proper output, for example, the output from the density sensor 126 may be acquired throughout a period during which the beam spot BS may be fully inside the range of the toner patch 302P, and the lowest among the outputs from the density sensor 126 may be selected. This method, however, requires a mass memory unit to temporarily store a large number of output values. Further, even after the proper output at the proper sampling time is received, that proper output can be identified only after the acquisition of outputs from the density sensor 126 over the entire sampling period is completed. Thus, the processing is delayed.

In view of the foregoing, in the present embodiment, the arrival timings of the respective color toner patches at the detection position 203 are predetermined or estimated, and an adjustment is executed so that the respective color toner patches can be detected at the proper sampling timings, which corresponds to the step S7 shown in FIG. 7. Specifically, based on the detection timings of the position adjustment patterns 301K, 301C, 301M, and 301Y used in the above-described position adjustment preceding immediately, the proper sampling timings (i.e., detection timings) for the respective color toner patches are identified, and the outputs from the density sensor 126 at those timings are acquired.

With this operation, even if the patch travel times Ta, Tb, Tc, and Td fluctuate, the amount of toner adhering to the toner patch can be detected at a proper timing such that the detection range of the toner amount detector falls inside the toner patch and the amount of toner adhering thereto can be detected with a higher degree of accuracy. Therefore, proper values indicating the image density (amount of adhering toner) can be detected.

Figure 9:
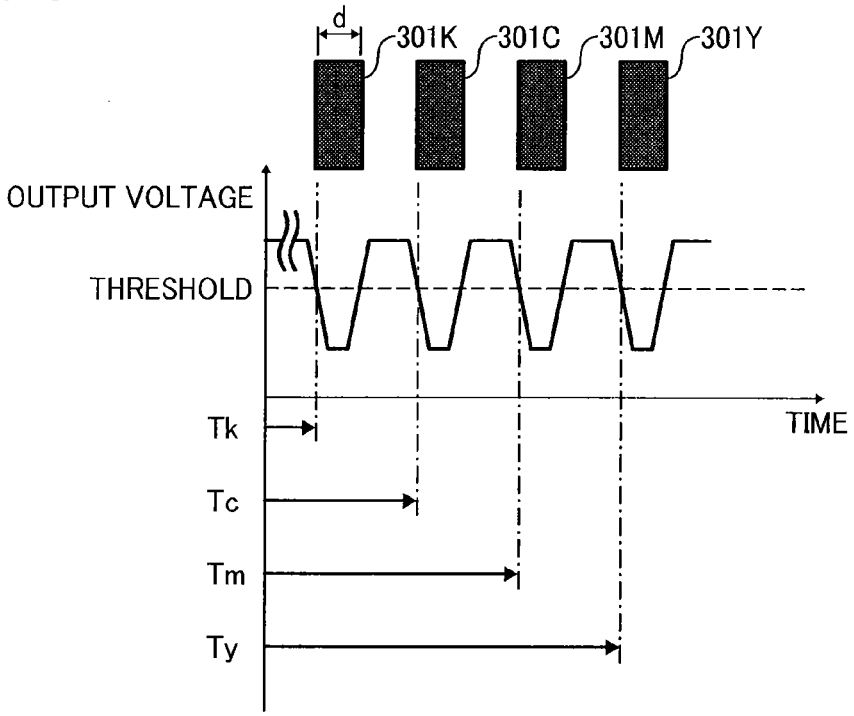
FIG. 9 is a chart for understanding of measurement of respective color patch travel times based on the detection timings of the position adjustment patterns.

FIG. 9 is a chart for understanding of measurement the respective color patch travel times Ta, Tb, Tc, and Td based on the detection timings of the position adjustment patterns 301K, 301C, 301M, and 301Y.

The outputs from the specular reflection receiver 128 during detection of the position adjustment patterns 301 are compared with a predetermined threshold (level). At that time, the timings at which the output from the light-receiving element 128 falls to the threshold is identified as the timings at which the position adjustment patterns 301K, 301C, 301M, and 301Y reach the detection position 203. These timings correspond to the start timings of proper detection of the amount of toner adhering to the position adjustment patterns 301K, 301C, 301M, and 301Y.

Referring to FIG. 9, times Tk, Tc, Tm, and Ty respectively represent periods from predetermined trigger timings to time points at which the position adjustment patterns 301K, 301C, 301M, and 301Y reach the detection position 203, that is, the start of proper detection of the amount of toner adhering to the position adjustment patterns 301K, 301C, 301M, and 301Y. Further, time periods from the predetermined trigger timings to the time points (exposure start timing) at which the exposure device 103 starts latent image formation for the position adjustment patterns 301K, 301C, 301M, and 301Y are referred to as "times Tk0, Tc0, Tm0, and Ty0". In this case, time periods from when the exposure device 103 starts latent image formation for the position adjustment patterns 301K, 301C, 301M, and 301Y to the start of proper detection of the amount of toner adhering to the position adjustment patterns 301K, 301C, 301M, and 301Y (position adjustment pattern travel times) can be expressed as "Tk-Tk0", "Tc-Tc0", "Tm-Tm0", and "Ty-Ty0", respectively. The position adjustment pattern travel times Tk-Tk0, Tc-Tc0, Tm-Tm0, and Ty-Ty0 correspond to the patch travel times Ta, Tb, Tc, and Td of the gradation patterns 302, respectively.

Next, descriptions are given below of time periods from the start of proper detection of the amount of toner adhering to the respective toner patches of the gradation patterns 302 to the completion of the proper detection of the amount of toner adhering (proper patch detection periods).

Figure 10:
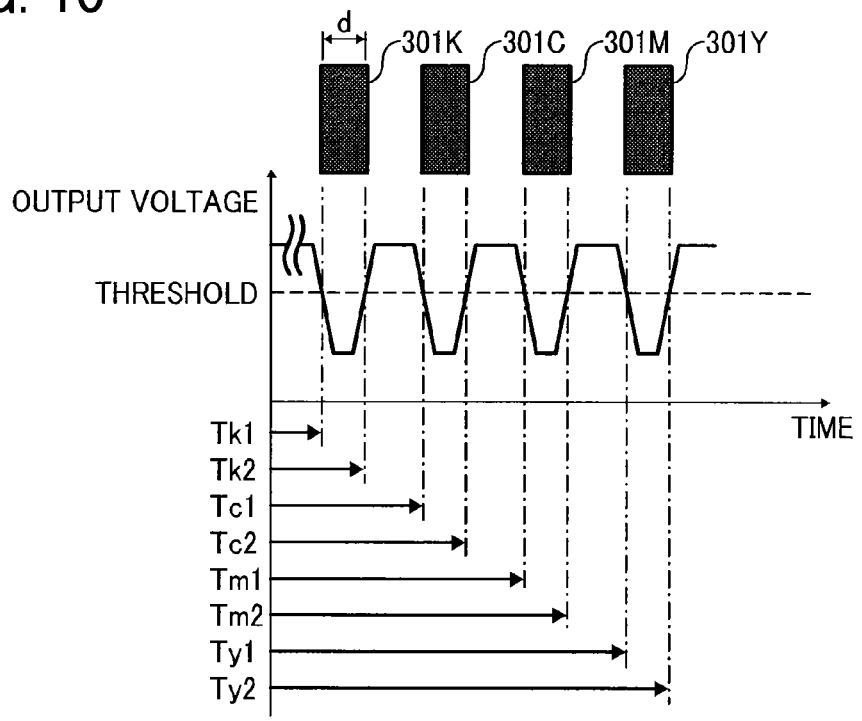
FIG. 10 is a chart for understanding of calculation of proper patch detection periods based on the detection timings of the position adjustment patterns.

FIG. 10 is a chart for understanding of calculation of the proper patch detection periods based on the detection timings of the position adjustment patterns 301K, 301C, 301M, and 301Y.

The outputs from the specular reflection receiver 128 during detection of the position adjustment patterns 301 are compared with a predetermined threshold (level). At that time, the timing at which the output from the specular reflection receiver 128 falls to the threshold and a subsequent timing at which output from the specular reflection receiver 128 exceeds the threshold are determined.

Referring to FIG. 10, times Tk1, Tc1, Tm1, and Ty1 respectively represent periods from predetermined trigger timings to time points at which outputs from the specular reflection receiver 128 detecting the position adjustment patterns 301K, 301C, 301M, and 301Y fall to the threshold. Further, times Tk2, Tc2, Tm2, and Ty2 respectively represent periods from the predetermined trigger timings to time points at which outputs from the specular reflection receiver 128 detecting the position adjustment patterns 301K, 301C, 301M, and 301Y exceed the threshold. By contrast, the times Tk0, Tc0, Tm0, and Ty0 mean the periods from the predetermined trigger timings to the start timings of latent image formation for the position adjustment patterns 301K, 301C, 301M, and 301Y.

In this case, the time periods from the exposure start timings of the exposure device 103 for forming the position adjustment patterns 301K, 301C, 301M, and 301Y to the start timings of proper detection of the amount of toner adhering to the position adjustment patterns 301K, 301C, 301M, and 301Y (position adjustment pattern travel times) can be expressed as: "Tk1-Tk0", "Tc1 -Tc0", "Tm1-Tm0", and "Ty1-Ty0", respectively. Additionally, in time periods from the start of proper detection of the amounts of toner adhering to the position adjustment patterns 301 to the completion of the proper detection of the toner adhering amounts are referred to as proper detection periods ΔTk, ΔTc, ΔTm, and ΔTy for position adjustment patterns 301. The proper detection periods ΔTk, ΔTc, ΔTm, and ΔTy (hereinafter collectively "ΔTx") for position adjustment patterns 301 can be calculated as:

$$\Delta Tk = Tk2 - Tk1,\ \Delta Tc = Tc2 - Tc1,\ \Delta Tm = Tm2 - Tm1,\ \text{and}\ \Delta Ty = Ty2 - Ty1.$$

Here, descriptions are given below of time periods from the start of proper detection of the amount of toner adhering to each color toner patch 302P to the completion of the proper detection of the toner adhering amount thereof (hereinafter "proper patch detection period t").

The proper patch detection period t for detecting the toner patch 302P can be expressed as:

$$t = L/v$$

wherein L represents an ideal length of the single toner patch 302P and v represents the process linear velocity (linear velocity of the photoreceptors 108). By contrast, when "d" represents an ideal length of the position adjustment pattern 301, the proper detection period ΔTx for position adjustment pattern 301 can be expressed as:

$$\Delta Tx = d/v.$$

Accordingly, the proper patch detection period t for the toner patch 302P can be calculated by formula 1 below, using the proper detection period ΔTx for position adjustment pattern 301.

$$t = (L/d) \times \Delta Tx \qquad \text{Formula 1}$$

Thus, in the present embodiment, based on the timings at which the density sensor 126 detects the position adjustment patterns 301 in a previous position adjustment (steps S4 to S6), the patch travel times Ta, Tb, Tc, and Td and the proper patch detection periods t for detecting the respective color toner patches 302P can be measured. The patch travel times Ta, Tb, Tc, and Td mean the period from the start timings of latent image formation for the toner patches at the exposure positions 201*a*, 201*b*, 201*c*, and 201*d* to the start timings of proper detection of the amount of toner adhering to thereto. Therefore, time periods from when the patch travel times Ta, Tb, Tc, and Td" elapses from the start of latent image formation for the toner patches at the exposure positions 201*a*, 201*b*, 201*c*, and 201*d* to the time points at which the proper patch detection periods t elapse are deemed sampling periods, and the gradation patterns 302 are detected (S10 shown in FIG. 7).

Figure 11:
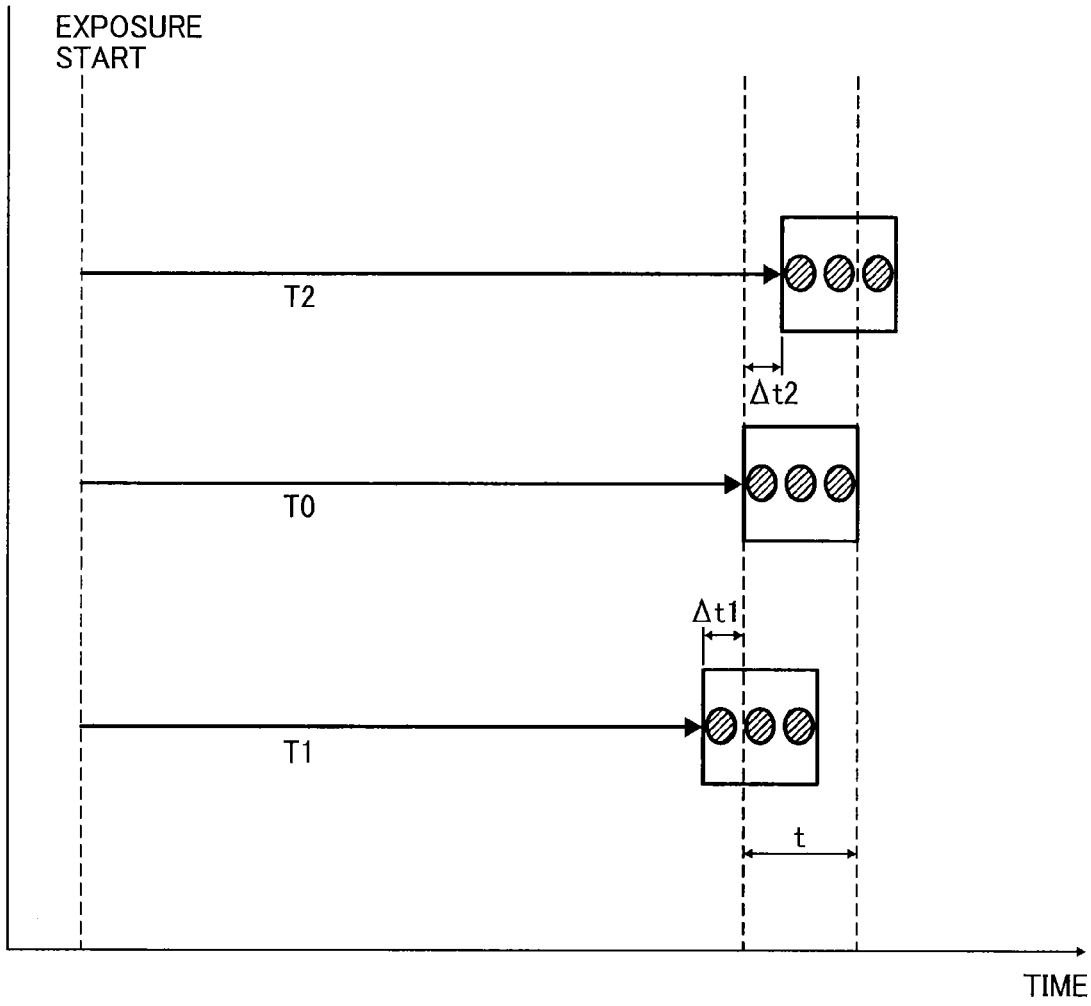
FIG. 11 is a chart for understanding of changing the timings to detect the toner patches (gradation patterns) according to the measured patch travel times.

FIG. 11 is a chart for understanding of changing the timings to detect the gradation patterns 302 according to the measured patch travel times Ta, Tb, Tc, and Td.

A reference time of the patch travel times Ta, Tb, Tc, and Td is referred to as "reference time T0". When the patch travel times Ta, Tb, Tc, and Td are shorter than the reference time T0, the deviation time is referred to as "deviation Δt1". When the patch travel times Ta, Tb, Tc, and Td are longer than the reference time T0, the deviation time is referred to as "deviation Δt2".

When the measured patch travel time Ta, Tb, Tc, or Td is identical to the reference time T0, a sampling start time t0 can be expressed as:

$$t0=T0+(S/2)/v$$

wherein S represents the beam spot diameter. In this case, the point of time when sampling is completed can be expressed as t0+t using the proper patch detection period t for the toner patch 302P thus obtained.

Additionally, when the measured value T1 of the patch travel time Ta, Tb, Tc, or Td is shorter than the reference time T0, a sampling start time t1 can be expressed as:

$$t1=t0+(T1-T0)=t0+\Delta t1.$$

In this case, the point of time when sampling is completed can be expressed as t1+t using the proper patch detection period t thus obtained.

Yet additionally, when the measured value T2 of the patch travel time Ta, Tb, Tc, or Td is longer than the reference time T0, a sampling start time t2 can be expressed as:

$$t2=t0+(T2T0)=t0+\Delta t2.$$

In this case, the point of time when sampling is completed can be expressed as t2+t using the proper patch detection period t thus obtained.

Thus, based on the timings at which the density sensor 126 detects the position adjustment patterns 301 used in the previous position adjustment (steps S4 to S6), the points of time when the toner patches 302P are detected are adjusted. Consequently, even if the patch travel times Ta, Tb, Tc, and Td fluctuate, proper values indicating the image density (toner adhering amount) can be detected.

According to the relation between the sampling intervals by the density sensor 126 and the length L of the single toner patch 302P, while one toner patch 302P formed on the intermediate transfer belt 120 passes through the detection range of the density sensor 126, multiple proper results (outputs from the density sensor 126) of detection of that toner patch can be acquired. In the configuration shown in the figures, three proper sensor outputs can be acquired for each toner patch as shown in FIG. 11. Accordingly, in this configuration, a mean value of the three output values is calculated, and the mean value is regarded as the amount of toner adhering to the toner patch 302P.

Referring to FIG. 7, at S11 the outputs of the density sensor 126 detecting the respective toner patches 302P of the respective color gradation patterns 302 can be converted into the amount of toner adhering (image density) using a toner adhering amount calculation algorithm established based on the relation between the amount of toner adhering and the sensor outputs.

In the present embodiment, the amount of toner adhering is calculated using both specular reflection and diffuse reflection of light reflected from the toner patch 302P, which is similar to a method described in U.S. Pat. No. 7,139,511, which is hereby incorporated by reference, and JP-2006-139180-A. Calculating the amount of toner adhering using both specular reflection and diffuse reflection of light is advantageous over calculating the amount of toner adhering using only specular reflection of light in increasing an effective detection range in a case in which the amount of toner adhering is greater. By using a calculation algorithm described in U.S. Pat. No. 7,139,511 and in JP-2006-139180-A, the amount of toner adhering can be calculated with a higher degree of accuracy even if the outputs from the light-emitting element and the light-receiving element fluctuate due to degradation over time or outputs from the light-receiving element change due to degradation over time of the intermediate transfer belt 120.

At S12, the image density adjustment is executed according to the amounts of toner adhering to the respective toner patches 302P thus calculated. The image density adjustment is based on the following principle. Based on the acquired amount of toner adhering, a formula indicating the amount of toner adhering relative to development potential is obtained. The inclination of this formula is referred to as "development γ", and an X-axis segment is referred to as "development threshold voltage". Then, based on the formula indicating the relation between the development potential and the amount of toner adhering, image forming conditions such as exposure energy (exposure power), charge bias, and development bias are changed so that a target toner adhering amount can be attained with a specific image density. Additionally, the concentration of toner in developer used as a control reference may be changed as required to adjust the concentration of toner in developer.

By contrast, when the position adjustment is not to be performed (No at S3), at S8 the controller 150 instructs formation of the respective color gradation patterns 302 so that these patterns pass though the positions on the intermediate transfer belt 120 opposed to the sensors 126*a*, 126*b*, and 126*c* as shown in FIGS. 4 and 5. However, the controller 150 does not instruct formation of the position adjustment patterns 301.

At S9, the controller 150 retrieves the latest correction amount stored in the RAM 152 of the controller 150 in the previous position adjustment and, based on the latest correction amount, calculates the amount by which the detection timing of the toner patches 302P is adjusted. In the case in which the controller 150 decides not to execute the position adjustment, at that time there are no changes that require adjustment of the latest correction amount. Accordingly, a proper value indicating the image density (toner adhering amount) of the toner patches 302P can be detected by calculating the correction amount of the detection timing of the toner patches 302P based on the latest correction amount, that is, the detection timings of the position adjustment patterns 301 when the latest correction amount is calculated.

It is to be noted that, although the position adjustment is executed at steps S4 through S6, if the position adjustment fails, it is deemed that detection of the position adjustment patterns 301 used in that position adjustment is abnormal. Then, the detection timing of the toner patch 302P is not corrected. In this case, the controller 150 may retrieve the latest correction amount stored in the RAM 152 of the controller 150 in the previous position adjustment and, based on the latest correction amount, calculate the amount by which the detection timing of the toner patches 302P is adjusted. Alternatively, image density adjustment itself may be aborted.

Additionally, the gradation patterns 302K, 302C, 302M, and 302Y are formed at predetermined fixed timings in the present embodiment. This control is advantageous in shortening time of image quality adjustment since formation of the gradation patterns 302 can be started without waiting for results of other adjustments or control operations.

The timing of formation of the gradation patterns 302, however, is not necessarily fixed. Alternatively, for example, the timings of formation of the respective color toner patches may be varied using the correction amount to correct the deviation in the relative positions among the respective color toner images, adjusted in an immediately preceding position adjustment (not the correction amount in a current image quality adjustment).

Alternatively, in the present embodiment, the detection timings of the toner patches may be adjusted so that relative detection timings among respective colors can be constant. Specifically, for example, the above-described detection timing of only the black toner patches 302P of the gradation pattern 302K may be adjusted, and, the detection timings of the other color gradation patterns 302C, 302M, and 302Y may be adjusted to timings predetermined periods shifted from the adjusted detection timing of the black toner patches 302P. In this case, adjustments of detection timings of the gradation patterns 302C, 302M, and 302Y can be simplified, thus reducing processing load and processing time.

It is to be noted that the steps in the above-described flowchart may be executed in an order different from that in the flowchart.

Further, any one of the above-described and other example features of the present invention may be embodied in the form of an apparatus, method, system, computer program and computer program product. For example, the aforementioned image quality adjustment method may be embodied in the form of a system or device, including, but not limited to, any of the structure for performing the methodology illustrated in the drawings.

Even further, the aforementioned method may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The various configurations according to the present inventions can attain specific effects as follows.

Aspect A: Aspect A concerns an image forming apparatus that includes an image forming device, such as the process units 102*a*, 102*b*, 102*c*, and 102*d*, to form toner images according to image data on an image bearer, such as the intermediate transfer belt 120, and a transfer device, such as the primary-transfer rollers 101 and the secondary-transfer roller 125, to transfer the toner image into a recording medium such a paper sheet, thereby forming an output image. The image forming apparatus further includes a toner amount detector, such as, the density sensor 126, to detect an amount of toner adhering to a density adjustment toner patch, such as the toner patch 302P (or the gradation patterns 302), formed by the image forming device, and an image density adjustment unit, such as the controller 150, to execute image density adjustment based on the amount of toner adhering, detected by the toner amount detector. The image density adjustment unit causes the image forming device to form a timing adjustment toner pattern, such as the position adjustment patterns 301K, 301C, 301M, and 301Y, for adjusting detection timing, before the gradation pattern 302 is formed. Further, the image density adjustment unit adjusts detection timing of the density adjustment toner patch based on detection timing at which the toner amount detector detects the timing adjustment toner pattern.

With this operation, the detection timing can be adjusted to enable detection of proper values indicating the image density (amount of adhering toner) even if the patch travel times Ta, Tb, Tc, and Td fluctuate. Thus, it is not necessary to extend the length of the density adjustment toner patch in view of fluctuations in the patch travel times Ta, Tb, Tc, and Td. Consequently, the amount of toner consumed in forming toner patches can be reduced, which is effective in reducing the frequency of replacement of a waste-toner container, such as the waste-toner container 124,and the running cost of the image forming apparatus.

Further, as the amount of toner removed in removal of the density adjustment toner patch can be reduced, this feature can suppress decreases in the operational life of a cleaning member, such as the cleaning blade 123.

Further, the time of image quality adjustment can be shortened since formation of the density adjustment toner patch (302P) can be started without waiting for acquisition of correction amount based on the detection timing of the timing adjustment toner pattern (301).

Additionally, since the deviation is corrected by adjustment of the detection timing of the density adjustment toner patch, acquisition of the correction amount of the timing to detect the timing adjustment toner pattern can be immediately before the density adjustment toner patch is detected by the toner amount detector. Therefore, formation of the density adjustment toner patch (302P) can be started without waiting for acquisition of correction amount based on the detection timing of the timing adjustment toner pattern (301).

Aspect B: In aspect A, the image forming device includes multiple image forming units, such as the process units 102*a*, 102*b*, 102*c*, and 102*d*, to form multiple toner images that together form a single superimposed image. The toner amount detector detects a relative-position adjustment toner pattern, such as the position adjustment patterns 301K, 301C, 301M, and 301Y, formed by the multiple image forming units. The image forming apparatus further includes a position adjustment unit, such as the controller 150, to adjust the relative positions among the multiple toner images formed by the respective image forming units, based on the detection timing of the relative-position adjustment toner pattern, detected by the toner amount detector. The image density adjustment unit uses the relative-position adjustment toner pattern as the timing adjustment toner pattern.

This operation can reduce the time of adjustment and toner consumption from those in a case in which the timing adjustment toner pattern is formed separately from the relative-position adjustment toner pattern.

Aspect C: In aspect B, the image forming device forms the relative-position adjustment toner pattern (i.e., 301) and the density adjustment toner patch (i.e., 302P) in succession in this order, and the image density adjustment unit adjusts the detection timing of the density adjustment toner patch by the toner amount detector according to the timing at which the toner amount detector detects the relative-position adjustment toner pattern.

This operation can reduce the time of image density adjustment.

Aspect D: In aspect B or C, when the detection of the relative-position adjustment toner pattern by the image density adjustment unit is improper, the image density adjustment unit does not adjust the detection timing of the density adjustment toner patch according to the detection timing of the relative-position adjustment toner pattern.

This control can prevent the detection timing of the density adjustment toner patch from being changed erroneously based on improper detection timing of the toner pattern. Thus, improper image density adjustments can be prevented.

Aspect E: In aspect B, the image forming apparatus further includes a storage device, such as the RAM 152, to store detection timing data based on the timing at which the toner amount detector detects the relative-position adjustment toner pattern. The image density adjustment unit adjusts the detection timing of the density adjustment toner patch by the toner amount detector according to the latest detection timing data stored in the storage device.

This operation can eliminate the need of detection of the relative-position adjustment toner pattern in adjusting the detection timing of the density adjustment toner patch, thus shortening the time of image density adjustment.

Aspect F: In any of aspects B through E, the length of each toner patch in the direction in which the density adjustment toner patch travels is shorter than the sum of the following two values:

1) a positional difference between a reference position of the density adjustment toner patch at reference time T0, at which the density adjustment toner patch reaches a detection range of the toner amount detector, and the position of the density adjustment toner patch at the reference time T0 when there is a maximum deviation within an adjustable range of the position adjustment (i.e., a maximum adjustable deviation); and 2) the length of the detection range (such as the beam spot diameter S) of the toner amount detector in the direction in which the density adjustment toner patch travels.

The range within which the toner image position is adjustable in the position adjustment equals to the maximum deviation in the toner patch position caused by fluctuations in the patch travel times Ta, Tb, Tc, and Td. Specifically, referring to FIG. 12, the maximum deviation in the toner patch position caused by fluctuations in the patch travel times Ta, Tb, Tc, and Td can be expressed as:

$$(\Delta t1max+\Delta t2max)\times v$$

wherein, within the adjustable range of the position adjustment, "Δt1max" represents a maximum deviation time when the patch travel time Ta, Tb, Tc, or Td is shorter than the reference time T0, and "Δt2max" represents a maximum deviation time when the patch travel time Ta, Tb, Tc, or Td is longer than the reference time T0. It is to be noted that, in FIG. 12, the detection range of the image density sensor is fixed.

The maximum deviation in the toner patch position corresponds to the positional difference between the reference toner patch position at reference time T0, at which the density adjustment toner patch (302P) reaches the detection range of the toner amount detector, and the toner patch position at the reference time T0 when there is a maximum deviation within an adjustable range of the position adjustment (i.e., a maximum adjustable deviation).

Figure 12:
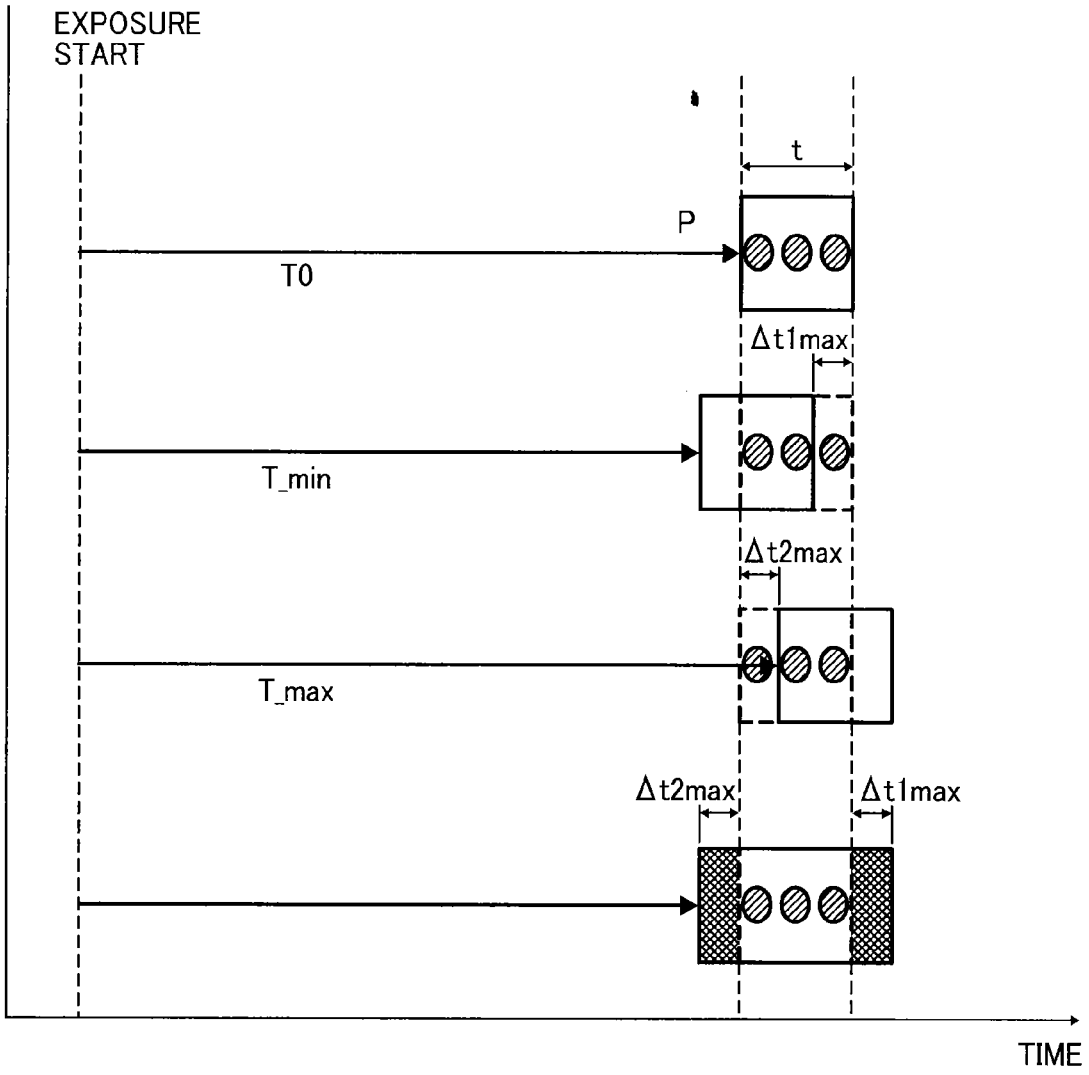
FIG. 12 is a schematic cross-sectional view for understanding of the length of the toner patch.

It is to be noted that, in a conventional configuration in which both of the start of formation of the density adjustment toner patch (i.e., gradation pattern 302) and detection timing thereof are fixed, as shown the lowest stage in FIG. 12, it is necessary that the length L of the toner patch is equal to or longer than the sum of the beam spot diameter S and the maximum deviation in the toner patch position (Δt1max+Δt2max)×v. By contrast, according to the aspect F, the detection timing of the density adjustment toner patch can be adjusted in response to the deviation even if there is the maximum adjustable deviation in the position adjustment. Accordingly, the length of the density adjustment toner patch can be shortened.

Aspect G: In any of aspects A through F, the density adjustment toner patch formed by the image forming device is formed at a predetermined fixed timing.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image forming device to form a toner image according to image data, a density adjustment toner pattern, and a timing adjustment toner pattern on an image bearer;

a detector to detect the density adjustment toner pattern and the timing adjustment toner pattern; and an image density adjustment unit to execute image density adjustment based on an amount of toner adhering to the density adjustment toner pattern detected by the detector, wherein the image density adjustment unit causes the image forming device to form the timing adjustment toner pattern on the image bearer before the density adjustment toner pattern is formed on the image bearer, the image density adjustment unit calculates an adjustment timing of the timing adjustment toner pattern, the adjustment timing being a difference between a predetermined arrival time of the timing adjustment toner pattern and an actual detection time of when the timing adjustment toner pattern is detected by the detector, the predetermined arrival time and the actual detection time of the timing adjustment toner pattern being on a same lap of the image bearer, and the image density adjustment unit adjusts a detection timing of the density adjustment toner pattern based on the adjustment timing.

2. The image forming apparatus according to claim 1, wherein the image forming device comprises multiple image forming units to form multiple toner images to be superimposed into a single image, the detector detects a relative-position adjustment toner pattern formed by the multiple image forming units, the image forming apparatus further comprises a position adjustment unit to adjust relative positions among the multiple toner images formed by the respective image forming units based on a detection timing of the relative-position adjustment toner pattern detected by the detector, and the image density adjustment unit uses the relative-position adjustment toner pattern as the timing adjustment toner pattern.

3. The image forming apparatus according to claim 2, wherein the image forming device forms the density adjustment toner pattern following formation of the relative-position adjustment toner pattern, and the image density adjustment unit adjusts the detection timing of the density adjustment toner pattern according to the adjustment timing.

4. The image forming apparatus according to claim 2, wherein when the detection of the relative-position adjustment toner pattern by the detector is improper, the image density adjustment unit does not adjust the detection timing of the density adjustment toner pattern according to the detection timing of the relative-position adjustment toner pattern.

5. The image forming apparatus according to claim 2, further comprising:

a storage device to store detection timing data based on the detection timing of the relative-position adjustment toner pattern, wherein the image density adjustment unit adjusts the detection timing of the density adjustment toner pattern according to the adjustment timing and latest detection timing data stored in the storage device.

6. The image forming apparatus according to claim 2, wherein the density adjustment toner pattern comprises multiple toner patches, and a length of each toner patch in a direction in which the density adjustment toner patch travels is shorter than a sum of:

1) a positional difference between a reference position of the toner patch at reference time T0, at which the toner patch reaches a detection range of the detector, and a position of the toner patch at the reference time T0 when there is a maximum deviation within an adjustable range of the position adjustment unit; and 2) a length of the detection range of the detector in the direction in which the density adjustment toner patch travels.

7. The image forming apparatus according to claim 1, wherein the image forming device forms the density adjustment toner pattern at a predetermined fixed timing.

8. The image forming apparatus according to claim 1, wherein the image density adjustment unit controls the image forming device to form the toner image according to the image data and according to the image density adjustment.

9. An image forming method comprising:

forming, with an image forming device, a toner image according to image data on an image bearer;

forming, with the image forming device, a timing adjustment toner pattern on the image bearer;

forming, with the image forming device, a density adjustment toner pattern on the image bearer after the timing adjustment toner pattern is formed on the image bearer;

detecting, with a detector, the density adjustment toner pattern and the timing adjustment toner pattern;

calculating, with an image density adjustment unit, an adjustment timing of the timing adjustment toner pattern, the adjustment timing being a difference between a predetermined arrival time of the timing adjustment toner pattern and an actual detection time of when the timing adjustment toner pattern is detected by the detector, and the predetermined arrival time and the actual detection time of the timing adjustment toner pattern being on a same lap of the image bearer; and executing, by the image density adjustment unit, an image density adjustment based on an amount of toner adhering to the density adjustment toner pattern detected by the detector, the image density adjustment adjusting a detection timing of the density adjustment toner pattern according to the adjustment timing.

10. The image forming method according to claim 9, wherein the image forming device comprises multiple image forming units to form multiple toner images to be superimposed into a single image, the detecting by the detector includes detecting a relative-position adjustment toner pattern formed by the multiple image forming units, and the method further comprises:

adjusting, by a position adjustment unit, relative positions among the multiple toner images formed by the respective image forming units based on a detection timing of the relative-position adjustment toner pattern detected by the detector, and using, by the image density adjustment unit, the relative-position adjustment toner pattern as the timing adjustment toner pattern.

11. The image forming method according to claim 10, further comprising:

forming, by the image forming device, the density adjustment toner pattern following formation of the relative-position adjustment toner pattern; and adjusting, by the image density adjustment unit, the detection timing of the density adjustment toner pattern according to the adjustment timing.

12. The image forming method according to claim 10, further comprising:

storing, by a storage device, detection timing data based on the detection timing of the relative-position adjustment toner pattern, wherein the adjusting by the image density adjustment unit includes adjusting the detection timing of the density adjustment toner pattern according to the adjustment timing and latest detection timing data stored in the storage device.

13. The image forming method according to claim 10, wherein the density adjustment toner pattern comprises multiple toner patches, and a length of each toner patch in a direction in which the density adjustment toner patch travels is shorter than a sum of:

1) a positional difference between a reference position of the toner patch at reference time T0, at which the toner patch reaches a detection range of the detector, and a position of the toner patch at the reference time T0 when there is a maximum deviation within an adjustable range of the position adjustment unit; and 2) a length of the detection range of the detector in the direction in which the density adjustment toner patch travels.

14. The image forming method according to claim 9, further comprising:

forming, by the image forming device, the density adjustment toner pattern at a predetermined fixed timing.

15. A non-transitory computer readable medium storing computer readable instructions that, when executed by an image forming apparatus, cause the image forming apparatus to:

form, with an image forming device, a toner image according to image data on an image bearer;

form, with the image forming device, a timing adjustment toner pattern on the image bearer;

form, with the image forming device, a density adjustment toner pattern on the image bearer after the timing adjustment toner pattern is formed on the image bearer;

detect, with a detector, the density adjustment toner pattern and the timing adjustment toner pattern;

calculate, with an image density adjustment unit, an adjustment timing of the timing adjustment toner pattern, the adjustment timing being a difference between a predetermined arrival time of the timing adjustment toner pattern and an actual detection time of when the timing adjustment toner pattern is detected by the detector, and the predetermined arrival time and the actual detection time of the timing adjustment toner pattern being on a same lap of the image bearer; and execute, by the image density adjustment unit, an image density adjustment based on an amount of toner adhering to the density adjustment toner pattern detected by the detector, the image density adjustment adjusting a detection timing of the density adjustment toner pattern according to the adjustment timing.

16. The non-transitory computer readable medium according to claim 15, wherein the image forming device comprises multiple image forming units to form multiple toner images to be superimposed into a single image, the detecting by the detector includes detecting a relative-position adjustment toner pattern formed by the multiple image forming units, and the image forming apparatus is further caused to:

adjust, by a position adjustment unit, relative positions among the multiple toner images formed by the respective image forming units based on a detection timing of the relative-position adjustment toner pattern detected by the detector, and use, by the image density adjustment unit, the relative-position adjustment toner pattern as the timing adjustment toner pattern.

17. The non-transitory computer readable medium according to claim 16, wherein the image forming apparatus is further caused to:

form, by the image forming device, the density adjustment toner pattern following formation of the relative-position adjustment toner pattern; and adjust, by the image density adjustment unit, the detection timing of the density adjustment toner pattern according to the adjustment timing.

18. The non-transitory computer readable medium according to claim 16, wherein the image forming apparatus is further caused to:

store, by a storage device, detection timing data based on the detection timing of the relative-position adjustment toner pattern, wherein the adjusting by the image density adjustment unit includes adjusting the detection timing of the density adjustment toner pattern according to the adjustment timing and latest detection timing data stored in the storage device.

19. The non-transitory computer readable medium according to claim 16, wherein the density adjustment toner pattern comprises multiple toner patches, and a length of each toner patch in a direction in which the density adjustment toner patch travels is shorter than a sum of:

1) a positional difference between a reference position of the toner patch at reference time T0, at which the toner patch reaches a detection range of the detector, and a position of the toner patch at the reference time T0 when there is a maximum deviation within an adjustable range of the position adjustment unit; and 2) a length of the detection range of the detector in the direction in which the density adjustment toner patch travels.

20. The non-transitory computer readable medium according to claim 15, wherein the image forming apparatus is further caused to:

form, by the image forming device, the density adjustment toner pattern at a predetermined fixed timing.

* * * * *